US009270055B2

(12) United States Patent
Campbell et al.

(10) Patent No.: US 9,270,055 B2
(45) Date of Patent: Feb. 23, 2016

(54) CONNECTOR WITH VIBRATORY CONNECTION FEEDBACK

(71) Applicant: DELPHI TECHNOLOGIES, INC., Troy, MI (US)

(72) Inventors: Jeffrey Scott Campbell, West Bloomefield, MI (US); Rangarajan Sundarakrishnamachari, Chennai (IN)

(73) Assignee: Delphi Technologies, Inc., Troy, MI (US)

( * ) Notice: Subject to any disclaimer, the term of this patent is extended or adjusted under 35 U.S.C. 154(b) by 113 days.

(21) Appl. No.: 14/249,426

(22) Filed: Apr. 10, 2014

(65) Prior Publication Data

US 2015/0295357 A1 Oct. 15, 2015

(51) Int. Cl.

| | |
|---|---|
| ***H01R 13/64*** | (2006.01) |
| ***H01R 13/641*** | (2006.01) |
| ***H01R 13/627*** | (2006.01) |
| ***H01R 43/26*** | (2006.01) |
| *H01R 13/639* | (2006.01) |

(52) U.S. Cl.

CPC ..... *H01R 13/641* (2013.01); *H01R 13/6272* (2013.01); *H01R 43/26* (2013.01); *H01R 13/639* (2013.01); *H01R 2201/26* (2013.01)

(58) Field of Classification Search

CPC ..... H01R 13/641

See application file for complete search history.

(56) References Cited

U.S. PATENT DOCUMENTS

| | | | | |
|---|---|---|---|---|
| 5,192,225 | A * | 3/1993 | Suzuki | H01R 13/641 439/350 |
| 5,391,087 | A * | 2/1995 | Fukuda | H01R 13/641 439/188 |
| 5,435,742 | A * | 7/1995 | Cecil, Jr. | H01R 13/639 439/347 |
| 5,827,086 | A * | 10/1998 | Fukuda | H01R 13/6272 439/357 |
| 6,491,542 | B1 * | 12/2002 | Zerebilov | H01R 13/4226 439/352 |
| 6,514,099 | B2 * | 2/2003 | Endo | H01R 13/641 439/357 |
| 7,381,084 | B1 | 6/2008 | Horn et al. | |
| 8,092,245 | B2 * | 1/2012 | Morello | H01R 13/6272 439/352 |
| 2003/0045161 | A1 * | 3/2003 | Endo | H01R 13/641 439/489 |
| 2008/0132098 | A1 * | 6/2008 | Tyler | H01R 13/62977 439/157 |
| 2009/0042454 | A1 | 2/2009 | Finona | |
| 2009/0186523 | A1 * | 7/2009 | Campbell | H01R 13/4365 439/595 |

FOREIGN PATENT DOCUMENTS

GB 2 379 566 A 3/2003

OTHER PUBLICATIONS

European Search Report dated Aug. 5, 2015.

* cited by examiner

*Primary Examiner* — James Harvey
(74) *Attorney, Agent, or Firm* — Robert J. Myers

(57) ABSTRACT

A connector having a connector body defining a first protrusion and a connector position assurance (CPA) device in the form of a sleeve axially surrounding the connector body that is moveable along a mating axis. The sleeve defines a second protrusion configured to engage the first protrusion when a first force is applied to the sleeve as the connector is mated with a corresponding mating connector. The second protrusion is configured to slide over the first protrusion and then disengage the first protrusion when a second force is applied to the sleeve, thereby producing a vibratory response in the sleeve. The vibratory response is a tactile vibration or an audible vibration. The second force applied to the sleeve is greater than the first force and the second force may be applied to the sleeve in the same direction as the first force or in the opposite direction.

20 Claims, 14 Drawing Sheets

CONNECTOR WITH VIBRATORY CONNECTION FEEDBACK

TECHNICAL FIELD OF THE INVENTION

The invention generally relates to connectors, and more particularly relates to a connector having a connector position assurance device with vibratory (tactile and/or auditory) connection feedback.

BACKGROUND OF THE INVENTION

The most numerous connector warranty issues for motor vehicle manufacturers are for electrical wiring connectors that were never fully mated in the vehicle assembly process. When vehicles having these improperly mated connectors are serviced, the connectors are observed to be "loose" or "not attached". Solving this problem in a cost effective and ergonomically acceptable way has eluded automotive connector designers for decades.

Connector designs that have connector position assurance features exist, but these connectors have used stored spring energy which increases the connector mating force two to four times over a similar connector without these connector position assurance features. Other connector designs utilize inertial latches to assure connector mating. These connectors provide a lower cost solution than the spring-based connectors, but also greatly increase connector mating forces compared to similar connector without these features.

The subject matter discussed in the Background of the Invention section should not be assumed to be prior art merely as a result of its mention in the Background of the Invention section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a connector is provided. The connector includes a connector body that defines a first protrusion and a sleeve axially surrounding the connector body and moveable relative to the connector body along a mating axis. The sleeve defines a second protrusion. The second protrusion is configured to engage the first protrusion when a first force is applied to the sleeve as the connector is mated with a corresponding mating connector. The second protrusion is configured to slide over the first protrusion and then disengage the first protrusion when a second force, distinct from the first force, is applied to the sleeve, thereby moving the sleeve from an initial position to a final position and producing a vibratory response in the sleeve. The second force applied to the sleeve may be greater than the first force and the second force may be applied to the sleeve in the same direction as the first force or in the opposite direction from the first force. The vibratory response may be a tactile vibration or an audible vibration. The sleeve may define a resilient cantilever beam where a free end of the cantilever beam defines the second protrusion. The sleeve may define a sleeve lock that is configured to hold the sleeve in the initial position until connector is fully mated with the corresponding mating connector. The connector may define a connector lock arm that is configured to engage a connector latch defined by the corresponding mating connector and the sleeve may be configured to inhibit disengagement of the connector lock arm from the connector latch when the sleeve is in the final position. The sleeve may define a lock stop configured to inhibit disengagement of the connector lock arm from the connector latch when a release button defined by the connector lock arm is pressed.

In accordance with another embodiment of this invention, a method of interconnecting a connector with a corresponding mating connector is provided. The connector has a connector body that defines a first protrusion and a sleeve that axially surrounds the connector body and is moveable relative to the connector body along a mating axis. The sleeve defines a second protrusion. The method includes the steps of applying a first force to the sleeve as the connector is mated with the corresponding mating connector, thereby engaging the first protrusion with the second protrusion and applying a second force, distinct from the first force, to the sleeve after the connector is fully mated with the corresponding mating connector, thereby moving the sleeve from an initial position to a final position, sliding the second protrusion over the first protrusion, and producing a vibratory response in the sleeve.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

Figure 1:
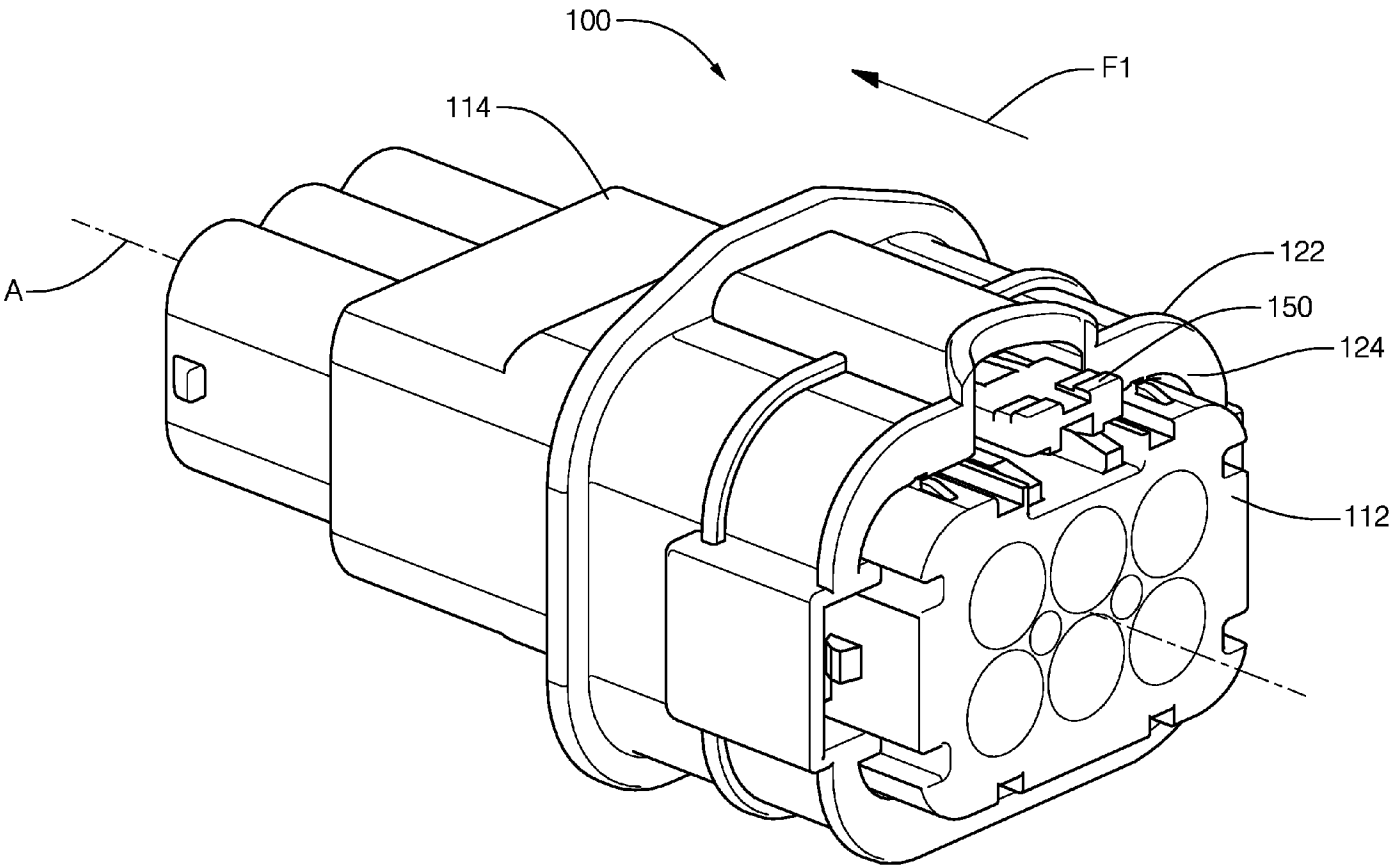
FIG. 1 is perspective view of a connector system having a connector position assurance (CPA) device in an initial position in accordance with a first embodiment.

Similar components are identified in the Figures by having the same last two digits of the reference numbers.

DETAILED DESCRIPTION OF THE INVENTION

FIGS. 1-14 illustrate a non-limiting example of a first embodiment of a connector system 100 that is configured to assure proper connection between a first connector 112 and a second mating connector 114. The connector system 100 is configured to provide vibratory feedback, i.e. a tactile vibration that can be felt be an operator and/or an audible click that can be heard by an operator connecting the first connector 112 to the second connector 114. The connector system 100 illustrated in FIGS. 1-14 generates the vibratory feedback after the first connector 112 is mated with the second connector 114.

According to the example illustrated in FIGS. 1-14, the first connector 112 has a first connector body 116 that is configured to mate within a cavity 118 defined by a second connector body 120 of the second connector 114 along a mating axis A. The first and second connector bodies 116, 120 also include electrical terminals (not shown) that are configured to be attached to wire cables (not shown) and to mate with one another to form electrical connections. The design and manufacture of connector bodies and electrical terminals are well known to those skilled in the art.

Figure 2:
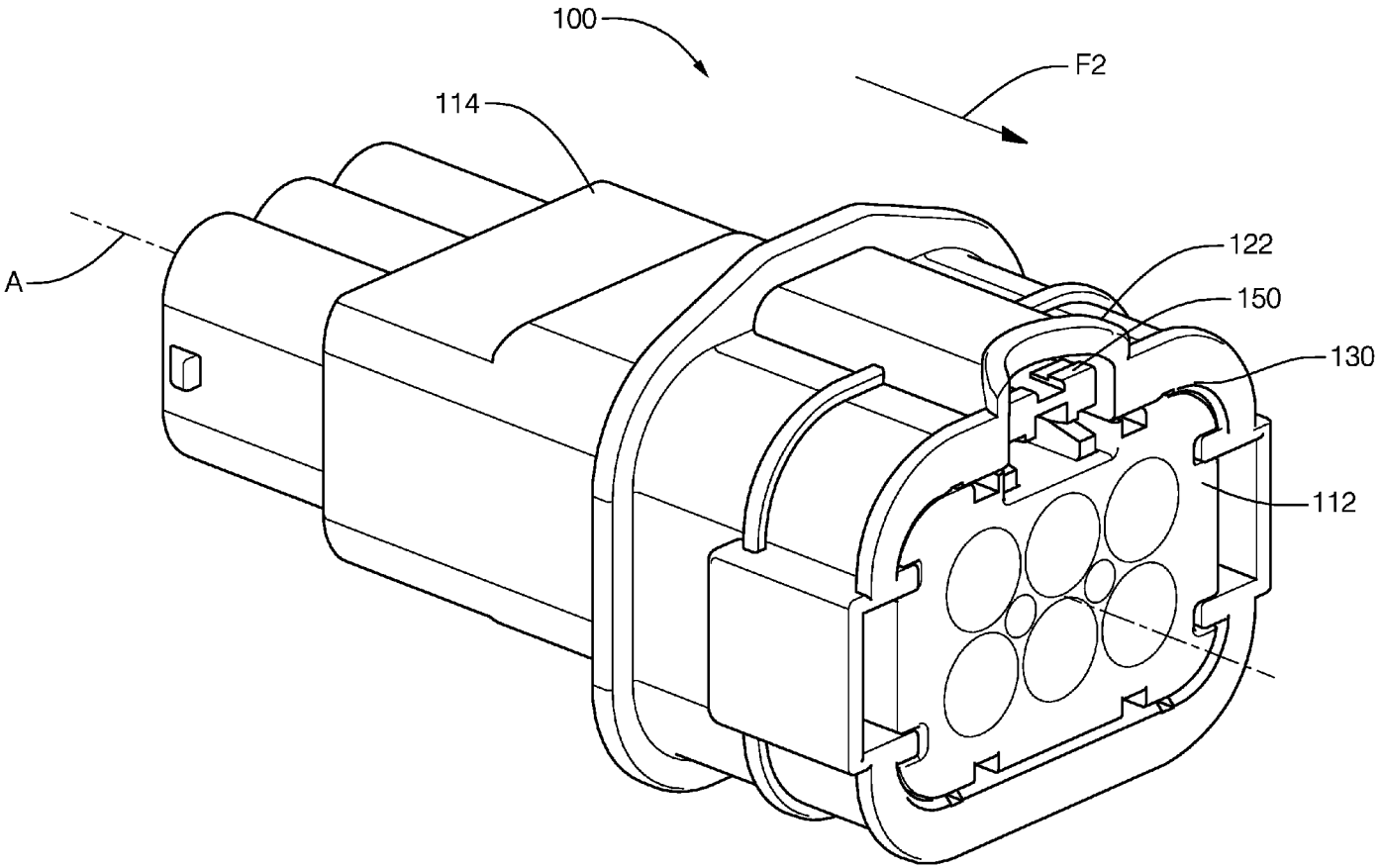
FIG. 2 is perspective view of the connector system of FIG. 1 with the CPA device in a final position in accordance with a first embodiment.

The first connector 112 also includes a connector position assurance (CPA) device 122 in the form of a sleeve 122 that axially surrounds the first connector 112. The sleeve 122 is movable or slideable along the mating axis A. The sleeve 122 is in an initial position 124 on the forward end of the first connector 112 as shown in FIG. 1. The operator inserts the first connector 112 into the second connector 114 by grasping the sleeve 122 and applying a first force F1 in the direction shown in FIG. 1. As the first force F1 is applied to the sleeve 122 by the operator, the first connector 112 slides into the cavity 118 of the second connector body 120 until the first connector 112 and the second connector 114 are fully mated. The first connector 112 includes a connector lock arm 126 that slides up and over a connector latch 128 defined by the second connector 114, thus securing first connector 112 to the second connector 114. In the fully mated condition, the first connector body 116 is fully inserted into the cavity 118 of the second connector body 120, the terminals of the first and second connector 112, 114 are engaged, and the connector lock arm 126 is fully engaged with the connector latch 128. After the first and second connector 112, 114 are fully mated, a second force F2 is applied to the sleeve 122 in a direction opposite the first force F1, thereby pulling the sleeve 122 from the initial position 124 on the forward end of the first connector 112 to a final position 130 on the rearward end of the first connector 112 so that the sleeve 122 covers the release button 150 of the connector lock arm 126 as shown in FIG. 2. This provides the connector position assurance function by inhibiting undesired release of the connector lock arm 126 from the connector latch 128.

Figure 3A:
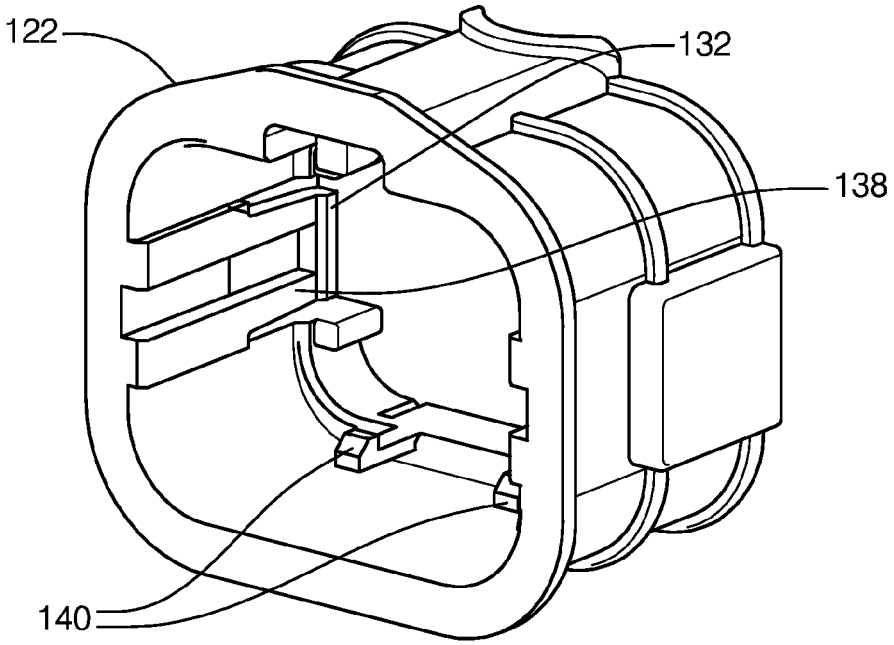
FIGS. 3A and 3B are perspective views of the interior of the CPA device of FIG. 1 in accordance with a first embodiment.
Figure 3B:
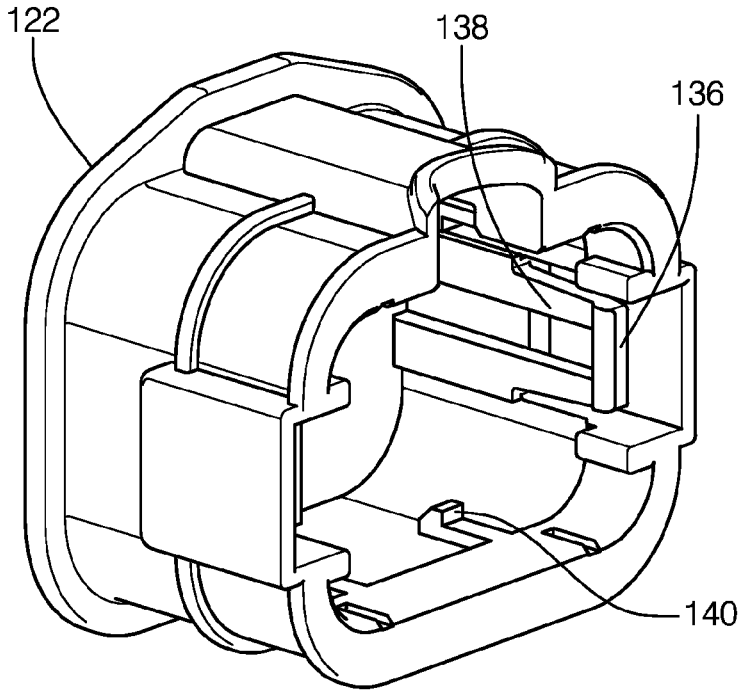
Figure 4:
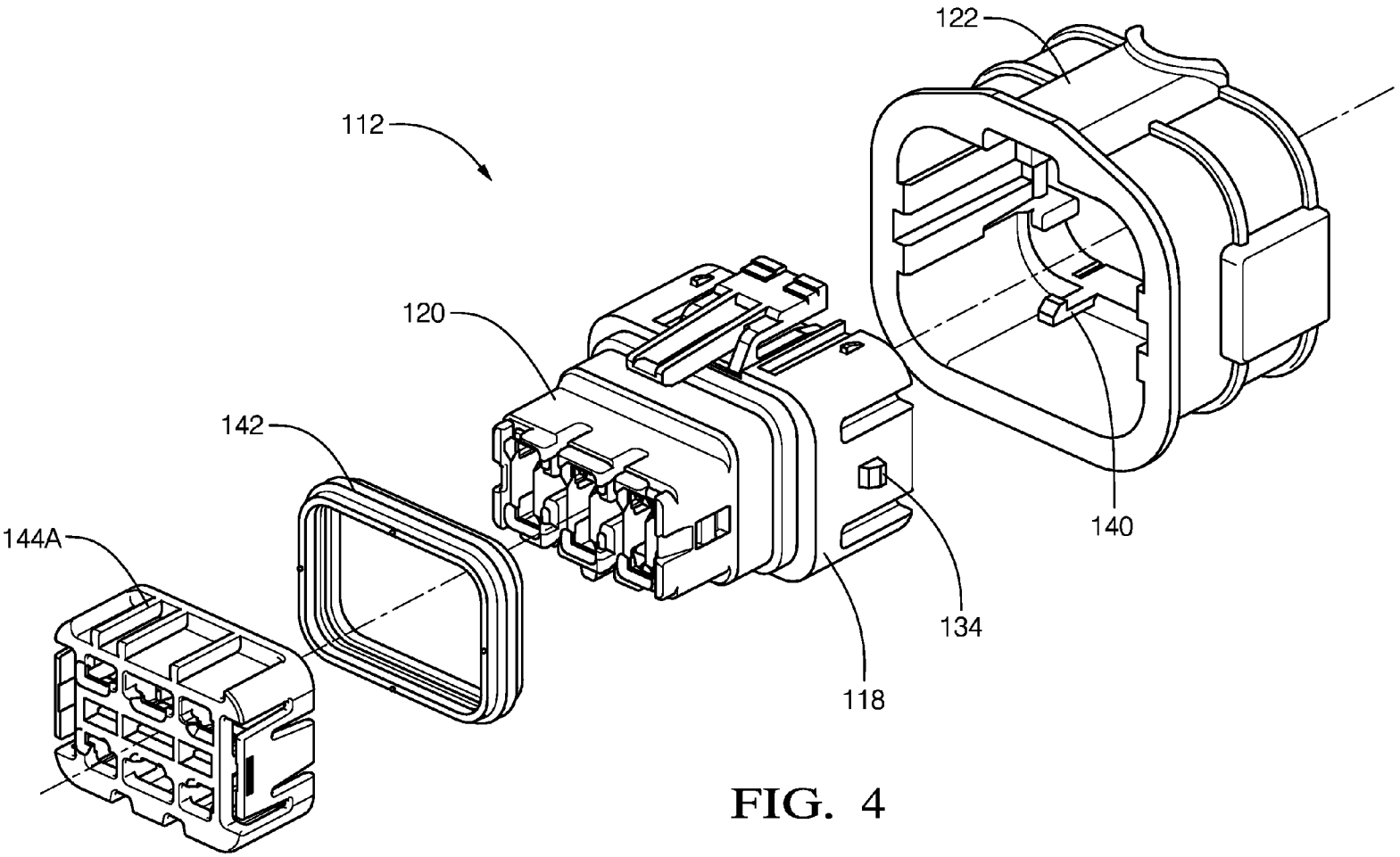
FIG. 4 are a perspective view and an exploded perspective view of a first connector system of FIG. 1 in accordance with a first embodiment.
Figure 5:
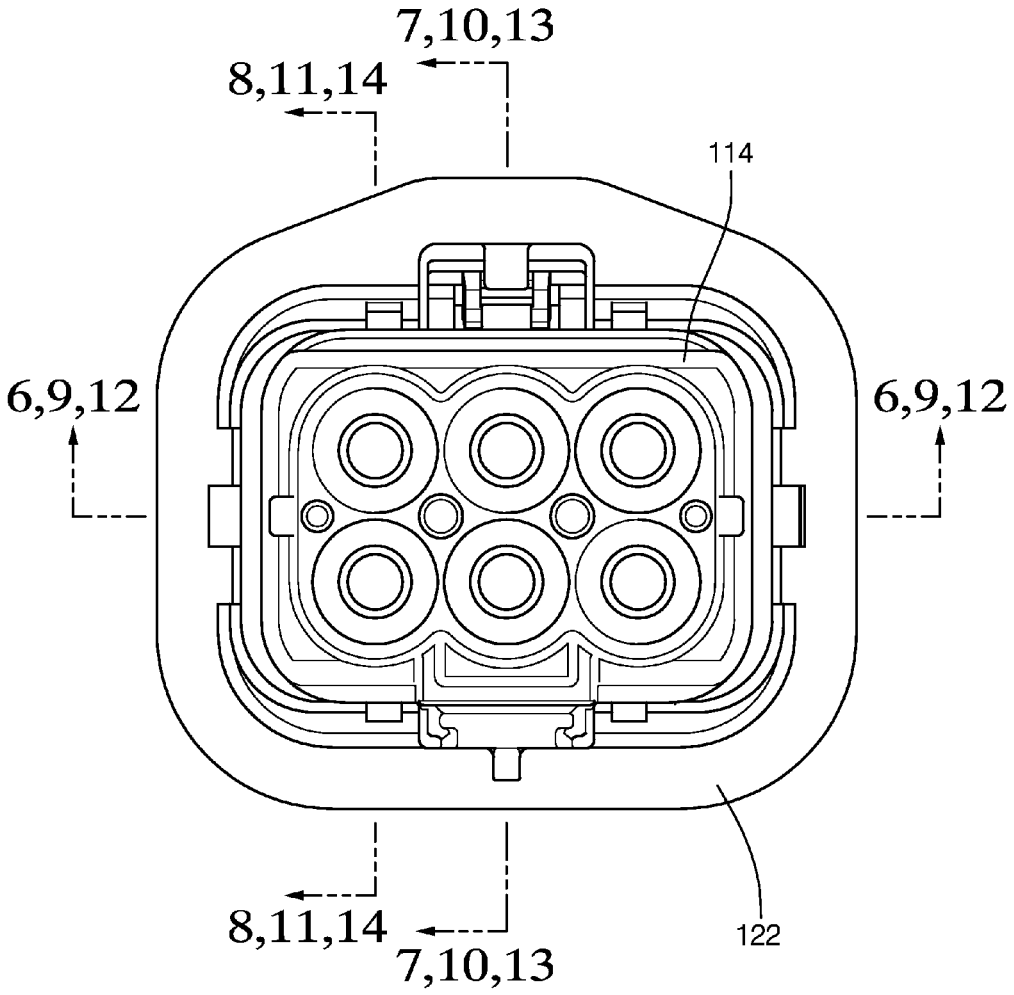
FIG. 5 is an end view of the connector systems of FIG. 1 and FIG. 15 illustrating the section lines of FIGS. 6-14 and FIGS. 17-26 in accordance with a first and a second embodiment.

As illustrated in FIG. 4, the first connector body 116 defines a first protrusion 134. FIG. 3 illustrates the structure of the interior of the sleeve 122. The second protrusion 132 includes an angled ridge 136 that engages the first protrusion 134. The angled ridge 136 is supported by a resilient cantilevered beam 138 that is configured to flex as the second protrusion 132 slides over and past the first protrusion 134. The sleeve 122 also includes a sleeve lock 140 that holds the sleeve 122 in the initial position 124 until first connector 112 is fully mated with the second connector 114. As the sleeve 122 slides from the initial position 124 to the final position 130, a second angled protrusion 132 on an interior surface of the sleeve 122 engages with a first angled protrusion 134 on an exterior surface of the second connector 114, see FIG. 4. As the second protrusion 132 slides over and past the first protrusion 134, the second protrusion 132 deforms a portion of the sleeve 122. When the second protrusion 132 slides clear of the first protrusion 134, the sleeve 122 snaps back to its original shape causing a vibration in the sleeve 122. The vibration may cause a tactile sensation that is felt by an operator grasping the sleeve 122 and/or it may produce an audible "click" that can be heard by the operator.

As shown in FIG. 4, the first connector 112 also includes a compliant seal 142 configured to inhibit contaminants from contacting the terminals. The first connector 112 and second connector 114 also include terminal position assurance (TPA)

devices 144A, 144B configured to maintain alignment of the terminals before the first and second connectors 112, 114 are mated.

Figure 6:
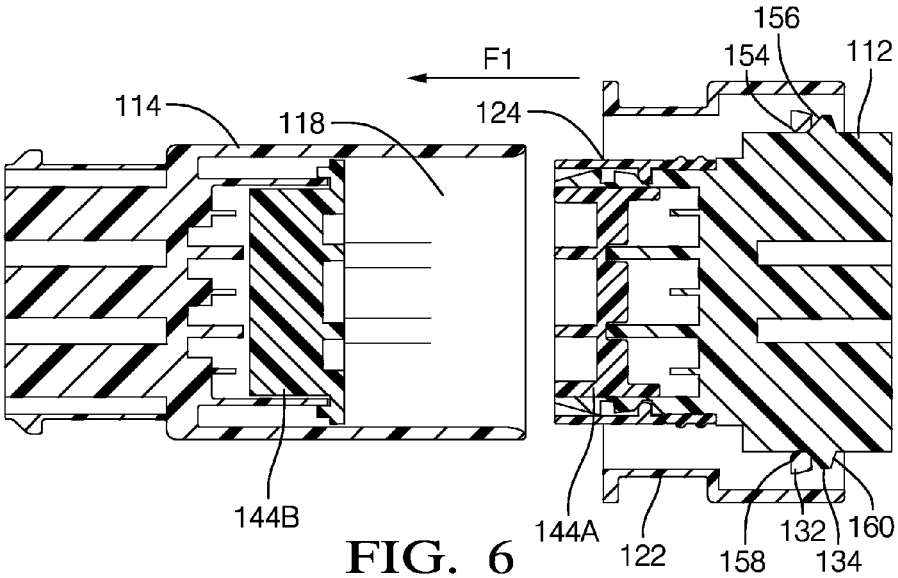
FIG. 6 is a cut away top view of the connector system of FIG. 1 along the section line A-A of FIG. 5 in an unmated position in accordance with a first embodiment.
Figure 7:
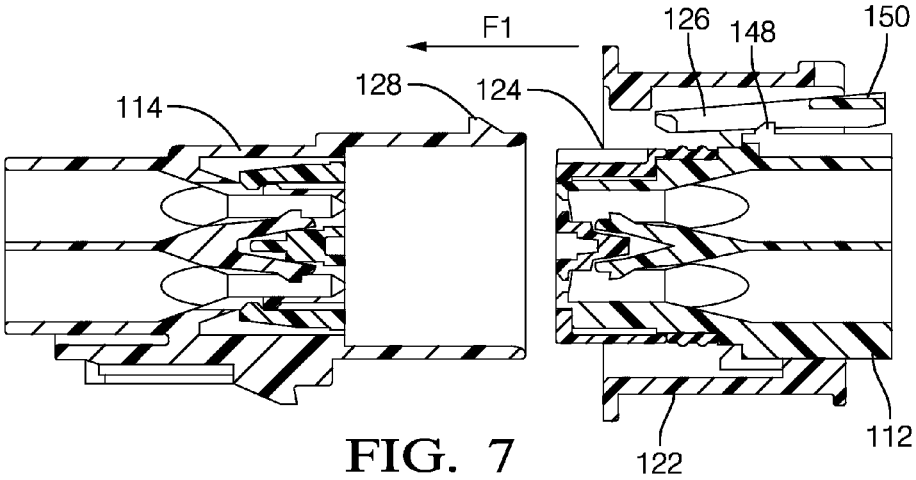
FIG. 7 is a cut away side view of the connector system of FIG. 1 along the section line B-B of FIG. 5 in an unmated position in accordance with a first embodiment.
Figure 8:
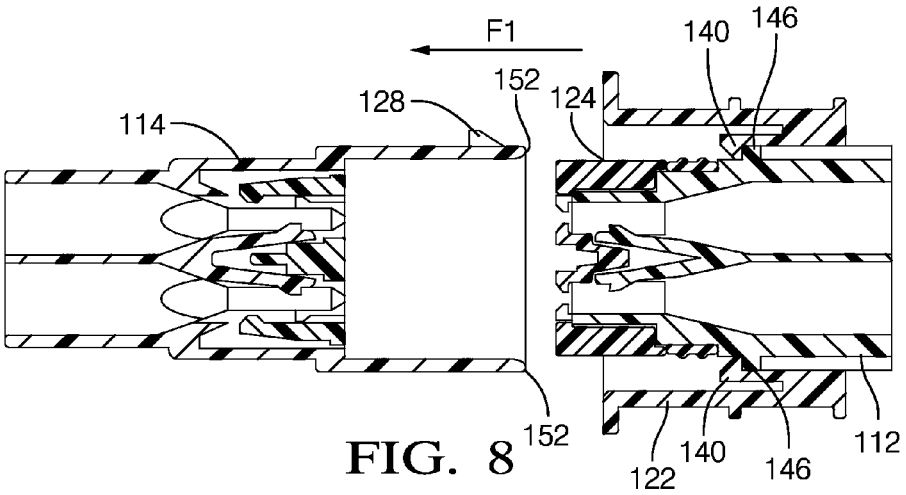
FIG. 8 is a cut away side view of the connector system of FIG. 1 along the section line C-C of FIG. 5 in an unmated position in accordance with a first embodiment.

FIGS. 6-8 illustrate the first and second connector 112, 114 in a pre-mated condition. In the pre-mated condition, the sleeve 122 is in the initial position 124 and as shown in FIG. 7, the second protrusion 132 is forward of the first protrusion 134. As shown in FIG. 8, the sleeve 122 is locked in the initial position 124 as the sleeve lock 140 is engaged with a boss 146 defined by the first connector body 116.

Figure 9:
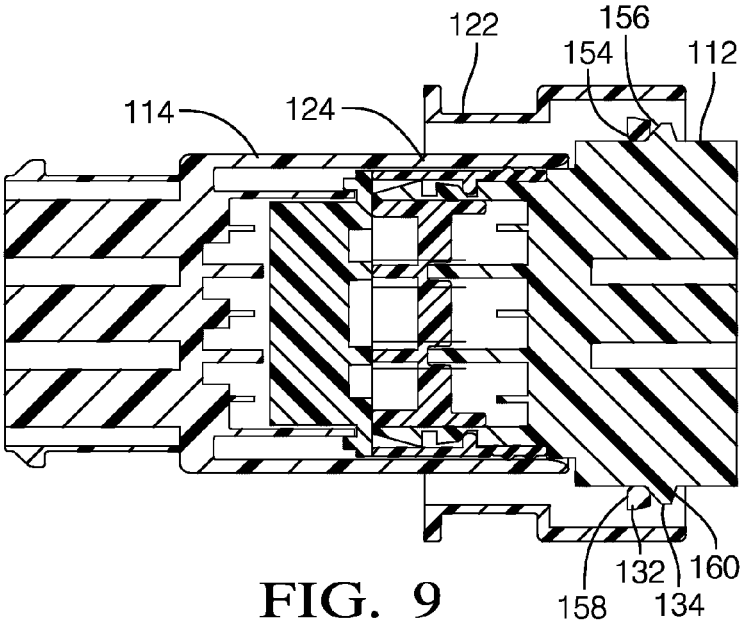
FIG. 9 is a cut away top view of the connector system of FIG. 1 along the section line A-A of FIG. 5 in a mated position and the CPA device in the initial position in accordance with a first embodiment.
Figure 10:
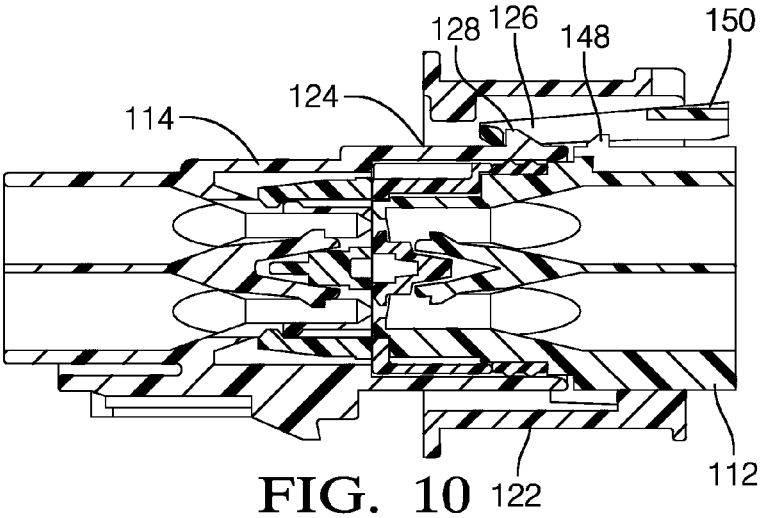
FIG. 10 is a cut away side view of the connector system of FIG. 1 along the section line B-B of FIG. 5 in a mated position and the CPA device in the initial position in accordance with a first embodiment.
Figure 11:
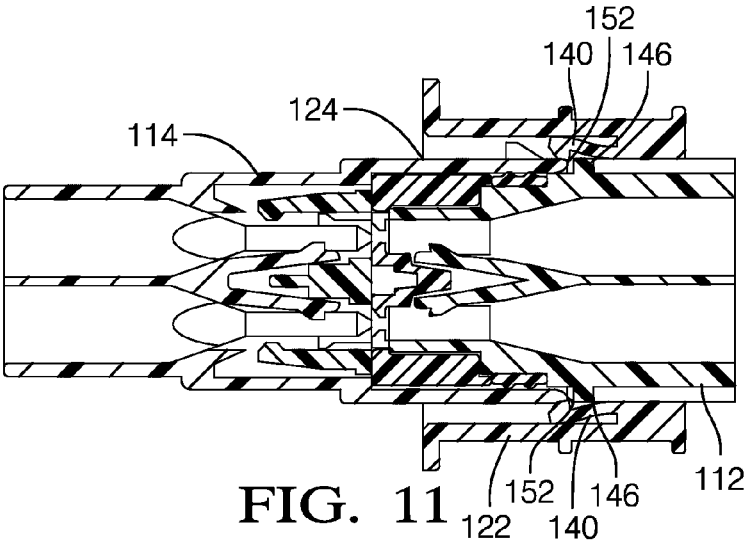
FIG. 11 is a cut away side view of the connector system of FIG. 1 along the section line C-C of FIG. 5 in a mated position and the CPA device in the initial position in accordance with a first embodiment.

FIGS. 9-11 illustrate the first and second connector 112, 114 is a fully mated condition. The sleeve 122 is still in the initial position 124, and so the second protrusion 132 is still forward of the first protrusion 134 as shown in FIG. 9. As the first connector body 116 is inserted into the cavity 118 of the second connector body 120, the connector lock arm 126 engages the connector latch 128 and flexes about a flexing member 148 as the lock arm 126 rides up and over the latch 128 until the lock arm 126 clears the latch 128 and snaps into place behind the latch 128 as shown in FIG. 10, thereby securing the first connector 112 to the second connector 114 until it is released by pressing the release button 150 on the rearward portion of the lock arm 126. As shown in FIG. 11, when the first and second connectors 112, 114 are fully mated, a forward edge 152 of the wall defining the second connector cavity 118 engages the sleeve lock 140 flexing the sleeve lock 140 away from the boss 146 and releasing the sleeve 122 to be able to slide from the initial position 124 to the final position 130.

Figure 12:
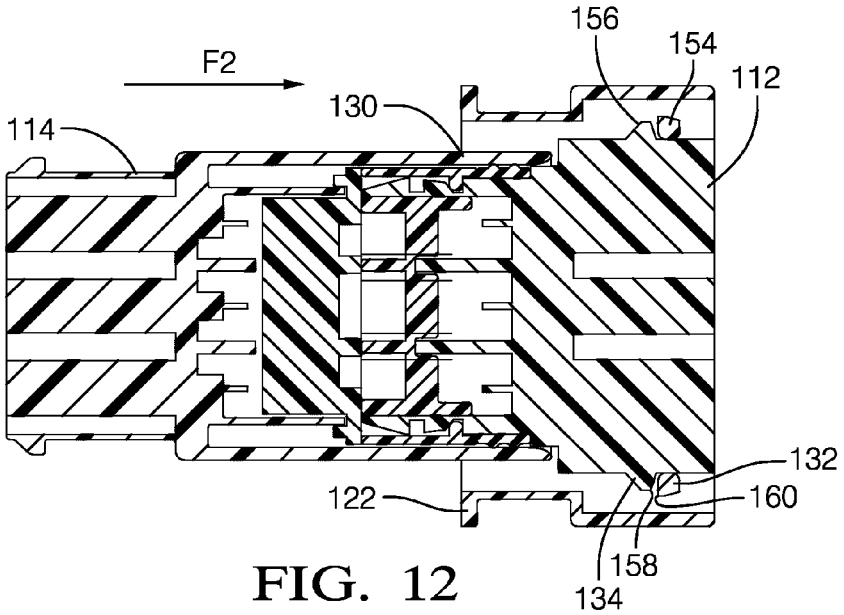
FIG. 12 is a cut away top view of the connector system of FIG. 1 along the section line A-A of FIG. 5 in a mated position and the CPA device in the final position in accordance with a first embodiment.
Figure 13:
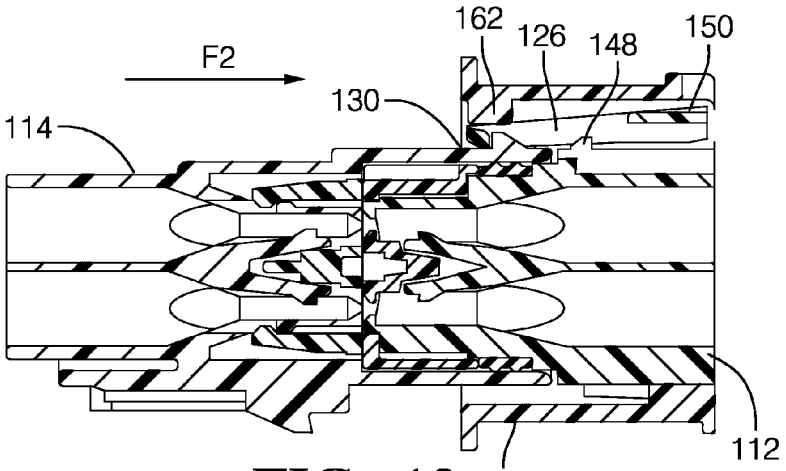
FIG. 13 is a cut away side view of the connector system of FIG. 1 along the section line B-B of FIG. 5 in a mated position and the CPA device in the final position in accordance with a first embodiment.
Figure 14:
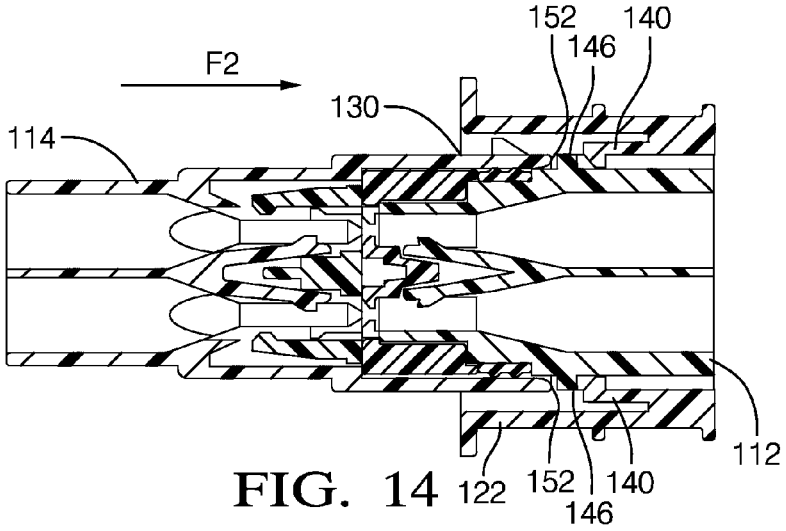
FIG. 14 is a cut away side view of the connector system of FIG. 1 along the section line C-C of FIG. 5 in a mated position and the CPA device in the final position in accordance with a first embodiment.

FIGS. 12-14 illustrate the sleeve 122 in the final position 130. As the second force F2 is applied to the sleeve 122, the sleeve 122 slides from the initial position 124 to the final position 130. An angled surface of the leading edge 154 of the second protrusion 132 engages an angled surface of the leading edge 156 of the first protrusion 134. The cantilevered beam 138 flexes and the second protrusion 132 rides up and over the first protrusion 134 until a trailing edge 158 of the second protrusion 132 clears a trailing edge 160 of the first protrusion 134. The trailing edges 158, 160 of the first and second protrusions 132, 134 have a steeper angle than the leading edges 154, 156, therefore the cantilevered beam 138 more rapidly snaps back to its initial shape when the second protrusion 132 clears the first protrusion 134 causing a vibration that may be heard or felt through the sleeve 122. As shown in FIG. 13, in the final position 130, a lock stop 262 defined by the sleeve 222 prevents the connector lock arm 126 from disengaging the latch 128 when the release button 250 of the connector lock arm 126 is pressed. The sleeve 122 also covers the release button 150 so that the lock arm 126 may not be inadvertently released.

The connector system 100 is configured so that the second force F2 required to slide first protrusion 134 over the second protrusion 132 as the sleeve 122 is moved from the initial to final position 130 is greater than the first force F1 required to mate the first and second connector 112, 114. Therefore, if the first and second connector 112, 114 are not fully mated and the connector arm is not engaged with the latch 128, the second force F2 will cause the first and second connector 112, 114 to be unmated and the person assembling the connectors will be immediately aware of an improper connection. The connector system 100 also provides the benefit of a lower connector mating force compared to prior art devices described in the Background of the Invention since the second force F2 required to move the sleeve 122 is separate from the first force F1 required to mate the first and second connectors 112, 114. Although the second force F2 required to activate the CPA device 122 is greater than the first force required to mate the first and second connectors 112, 114, the second force F2 may still be less than two to four times as great as the first force F1 as is required by the prior art devices described in the Background of the Invention.

FIGS. 15-26 illustrate a non-limiting example a second embodiment of a connector system 200 that is configured to assure proper connection between a first connector 212 and a second mating connector 214. The connector system 200 is configured to provide vibratory feedback, i.e. a tactile vibration that can be felt be an operator and/or an audible click that can be heard by an operator connecting the first connector 112 to the second connector 114. The connector system 200 illustrated in FIGS. 15-26 generates the vibratory feedback after the first connector 112 is mated with the second connector 114.

According to the example illustrated in FIGS. 15-26, the first connector 212 has a first connector body 216 that is configured to mate within a cavity 218 defined by a second connector body 220 of the second connector 214 along a mating axis A. The first and second connector bodies 216, 220 also include electrical terminals (not shown) that are configured to be attached to wire cables (not shown) and to mate with one another to form electrical connections.

Figure 15:
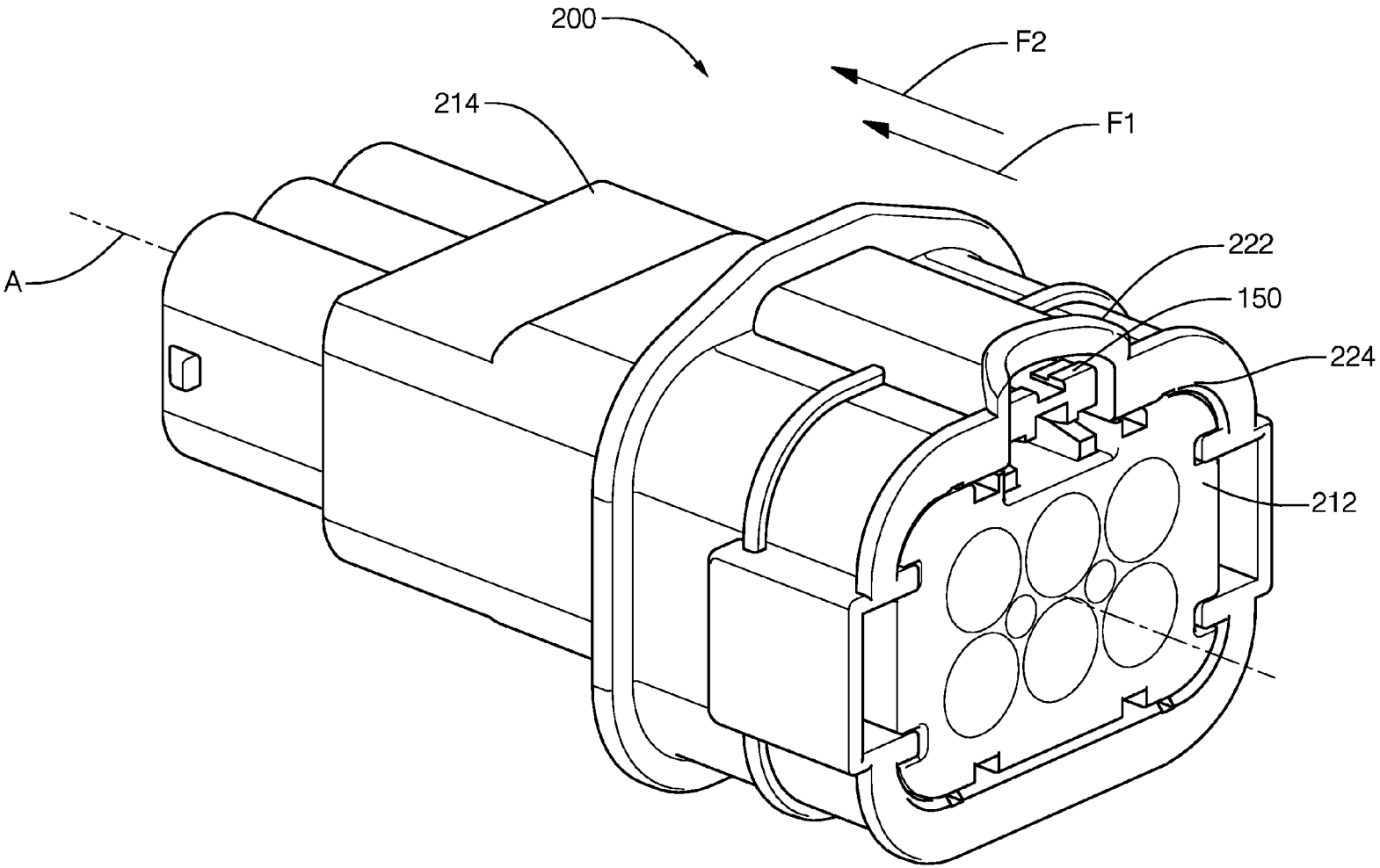
FIG. 15 is perspective view of a connector system having a CPA device in an initial position in accordance with a second embodiment.
Figure 25:
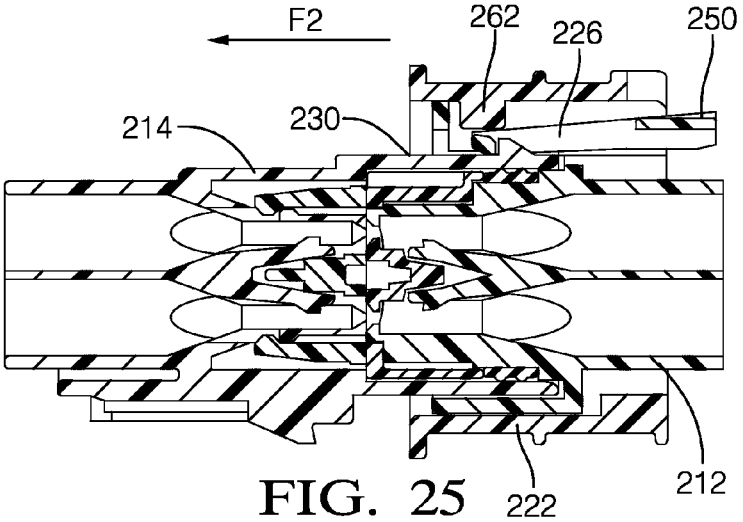
FIG. 25 is a cut away side view of the connector system of FIG. 15 along the section line B-B of FIG. 5 in a fully mated position in accordance with a second embodiment.

The first connector 212 also includes a CPA device 222 in the form of a sleeve 222 that axially surrounds the first connector 212. The sleeve 222 is moveable or slideable along the mating axis A. The sleeve 222 is in an initial position 224 on the rearward end of the first connector 112 as shown in FIG. 15. The operator inserts the first connector 212 into the second connector 214 by grasping the sleeve 222 and applying a first force F1 in the direction shown in FIG. 15. As the first force F1 is applied to the sleeve 222 by the operator, the first connector 212 slides into the cavity 218 of the second connector body 220 until the first connector 212 and the second connector 214 are fully mated. The first connector 212 includes a connector lock arm 226 that slides up and over a connector latch 228 defined by the second connector 214, thus securing first connector 212 to the second connector 214. In the fully mated condition, the first connector body 216 is fully inserted into the cavity 218 of the second connector body 220, the terminals of the first and second connector 212, 214 are engaged, and the connector lock arm 226 is fully engaged with the connector latch 228. After the first and second connector 212, 214 are fully mated, a second force F2 is applied by the operator to the sleeve 122 in the same direction as the first force F1, thereby pushing the sleeve 222 from the initial position 224 on the rearward end of the first connector 212 to a final position 230 on the forward end of the first connector 212 so that a lock stop 262 defined by the sleeve 222 prevents the connector lock arm 226 from disengaging the latch 228 when the release button 250 of the connector lock arm 226 is pressed as shown in FIG. 25. This provides the connector position assurance function by inhibiting undesired release of the connector lock arm 226 from the connector latch 228.

Figure 16A:
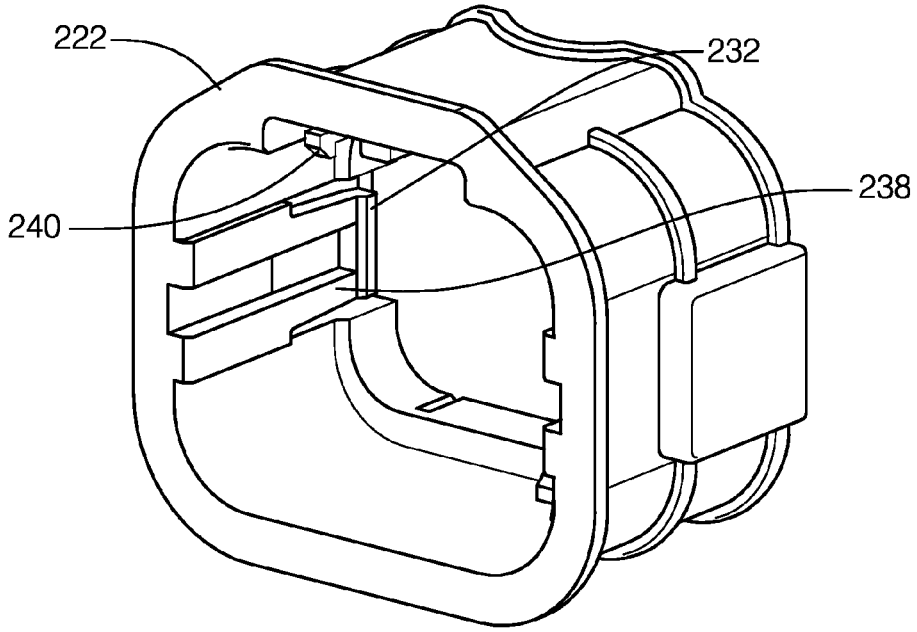
FIGS. 16A and 16B are perspective views of the interior of the CPA device of FIG. 15 in accordance with a second embodiment.
Figure 16B:
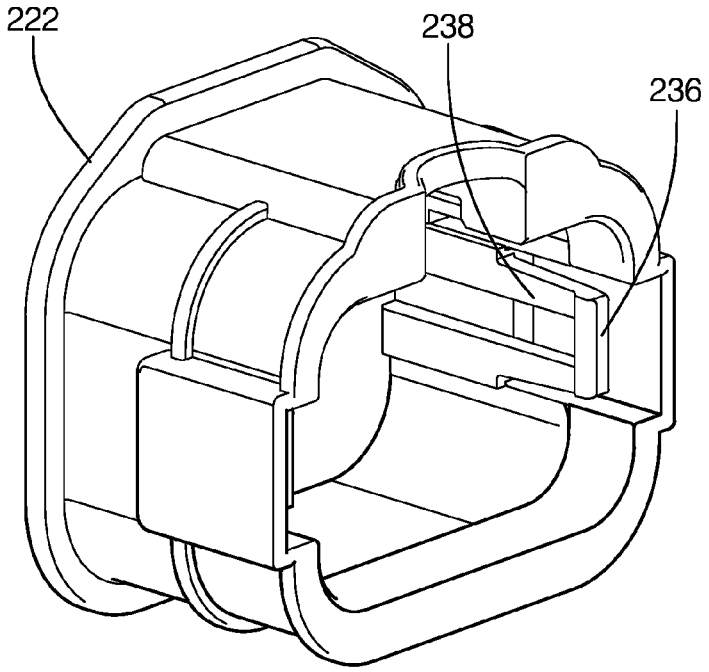

FIG. 16 illustrates the structure of the interior of the sleeve 222. The second protrusion 232 includes an angled ridge 236 that engages the first protrusion 234. The angled ridge 236 is supported by a resilient cantilevered beam 238 that is configured to flex as the second protrusion 232 slides over and past the first protrusion 234. The sleeve 222 also includes a sleeve lock 240 that holds the sleeve 222 in the initial position 224 until first connector 212 is fully mated with the second connector 214. As the sleeve 222 slides from the initial position 224 to the final position 230, a second angled protrusion 232 on an interior surface of the sleeve 222 engages with a first angled protrusion 234 on an exterior surface of the second connector 214, see FIG. 17. As the second protrusion 232 slides over and past the first protrusion 234, the second protrusion 232 deforms a portion of the sleeve 222. When the second protrusion 232 slides clear of the first protrusion 234, the sleeve 222 snaps back to its original shape causing a vibration in the sleeve 222. The vibration may cause a tactile sensation that is felt by an operator grasping the sleeve 222 and/or it may produce an audible "click" that can be heard by the operator.

Figure 17:
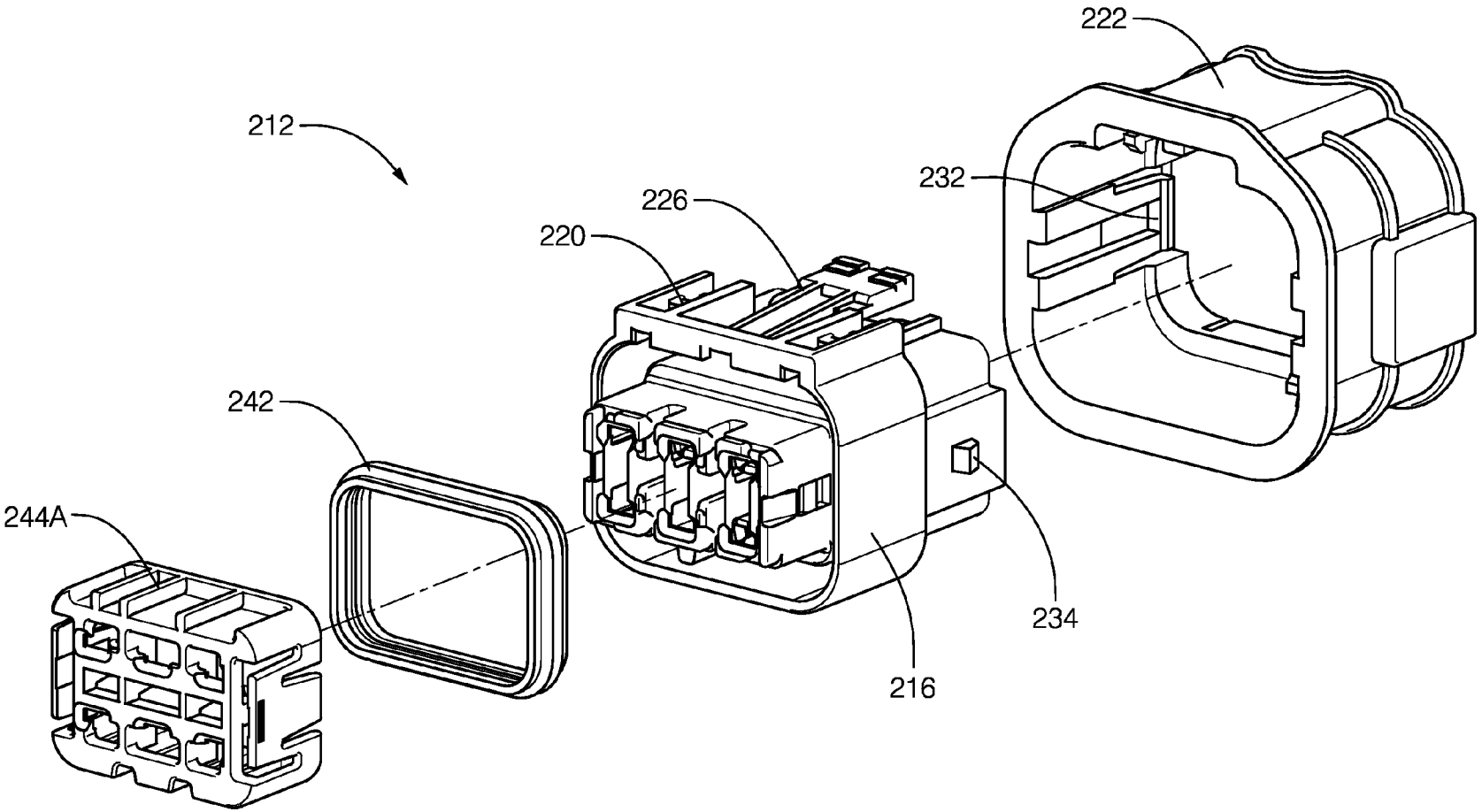
FIG. 17 is an exploded perspective view of a first electrical connector including the CPA device of FIG. 16 in accordance with a second embodiment.

As shown in FIG. 17, the first connector 212 also includes a compliant seal 242 configured to inhibit contaminants from contacting the terminals. The first connector 212 and second connector 214 also include terminal position assurance (TPA) devices 244A, 244B configured to maintain alignment of the terminals before the first and second connectors 212, 214 are mated.

Figure 18:
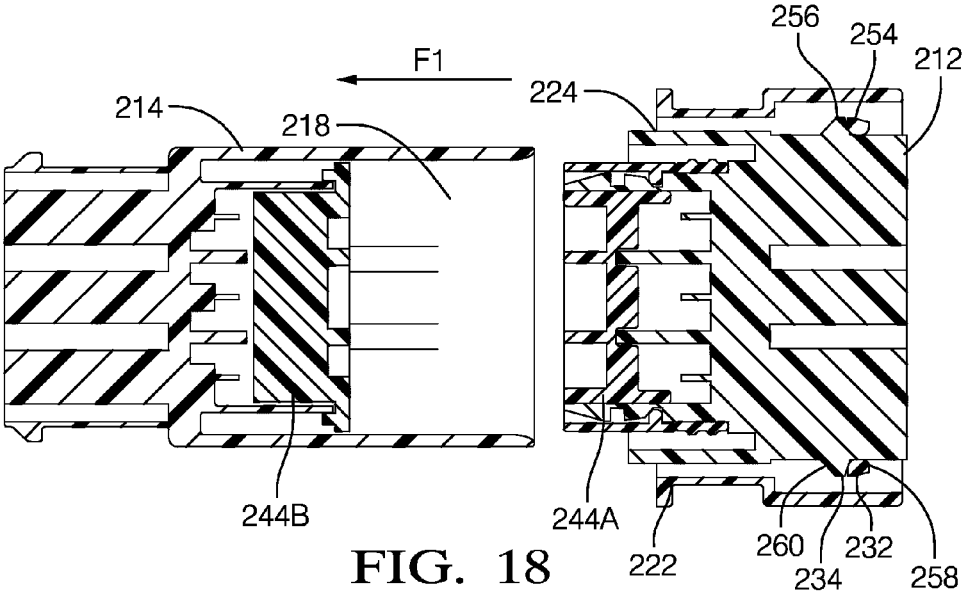
FIG. 18 is a cut away top view of the connector system of FIG. 15 along the section line A-A of FIG. 5 in an unmated position in accordance with a second embodiment.
Figure 19:
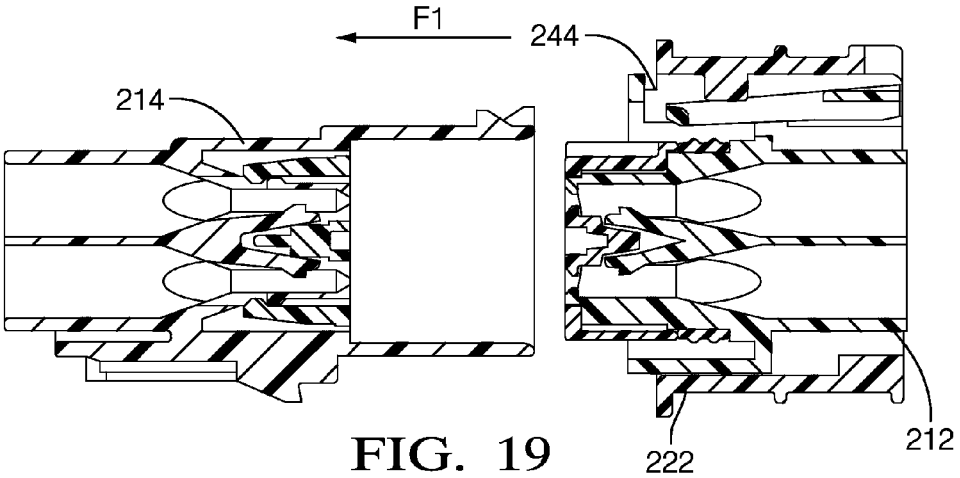
FIG. 19 is a cut away side view of the connector system of FIG. 15 along the section line B-B of FIG. 5 in an unmated position in accordance with a second embodiment.
Figure 20:
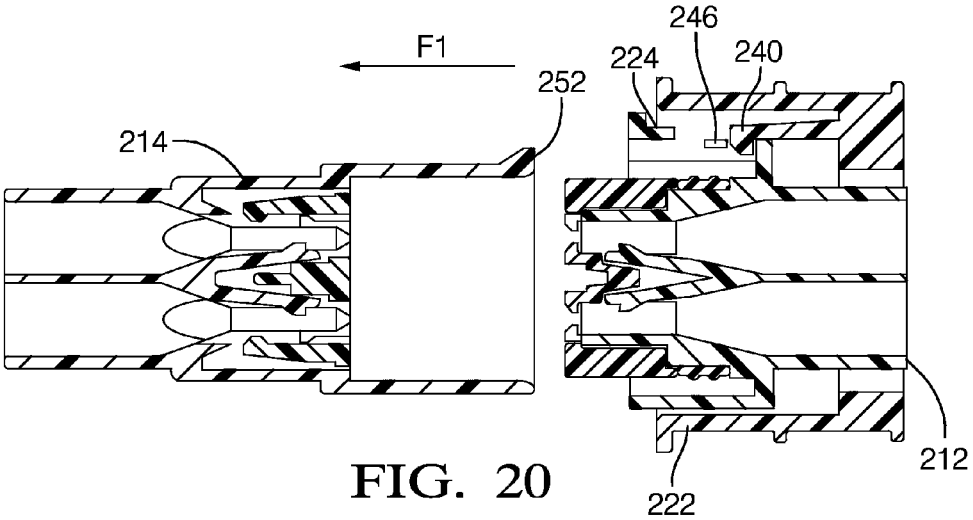
FIG. 20 is a cut away side view of the connector system of FIG. 15 along the section line C-C of FIG. 5 in an unmated position in accordance with a second embodiment.

FIGS. 18-20 illustrate the connector system 200 with the first and second connector 212, 214 in a pre-mated condition. A first force F1 sufficient to mate the first and second connector 212, 214 is applied by the operator to the sleeve 222. As shown in FIG. 18, with the sleeve 222 in an initial position 224, the second protrusion 232 is rearward of the first protrusion 234. As shown in FIG. 20, the sleeve 222 is locked in the initial position 224 as the sleeve lock 240 is engaged with a boss 246 defined by the first connector body 216.

Figure 21:
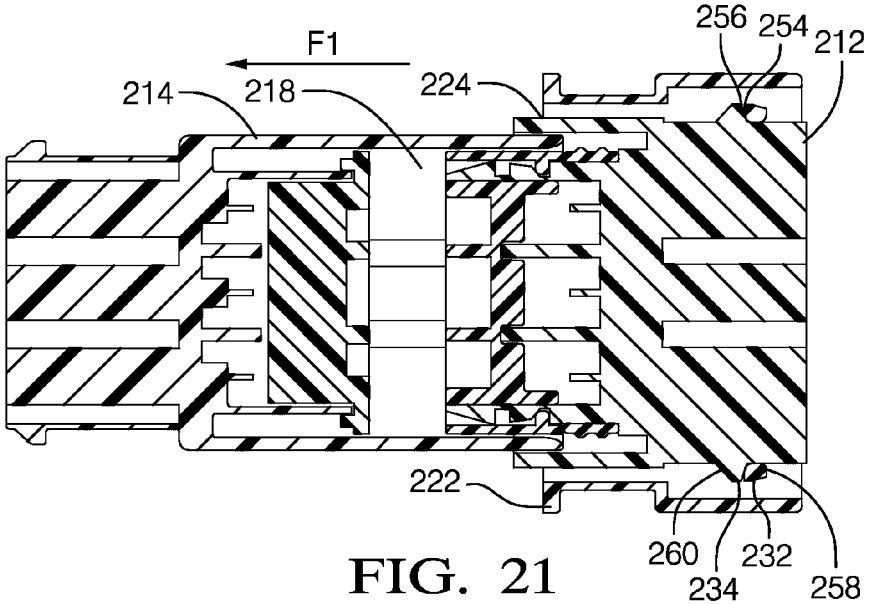
FIG. 21 is a cut away top view of the connector system of FIG. 15 along the section line A-A of FIG. 5 in a partially mated position in accordance with a second embodiment.
Figure 22:
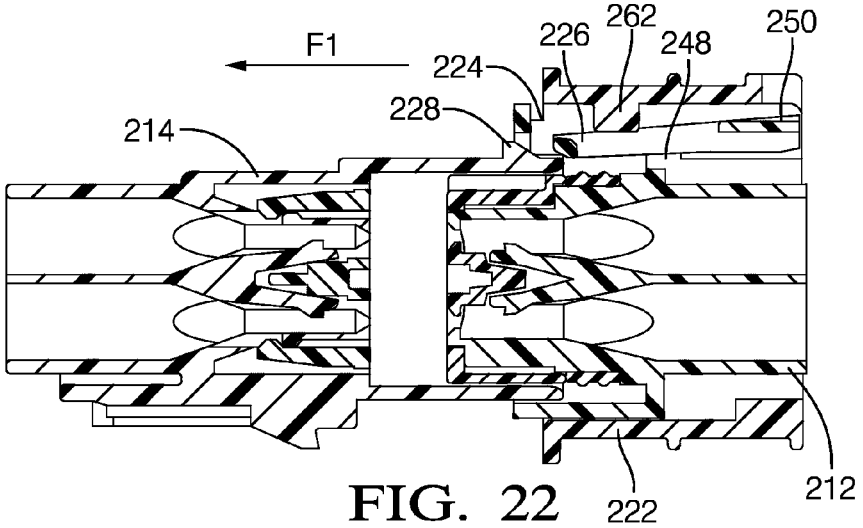
FIG. 22 is a cut away side view of the connector system of FIG. 15 along the section line B-B of FIG. 5 in a partially mated position in accordance with a second embodiment.
Figure 23:
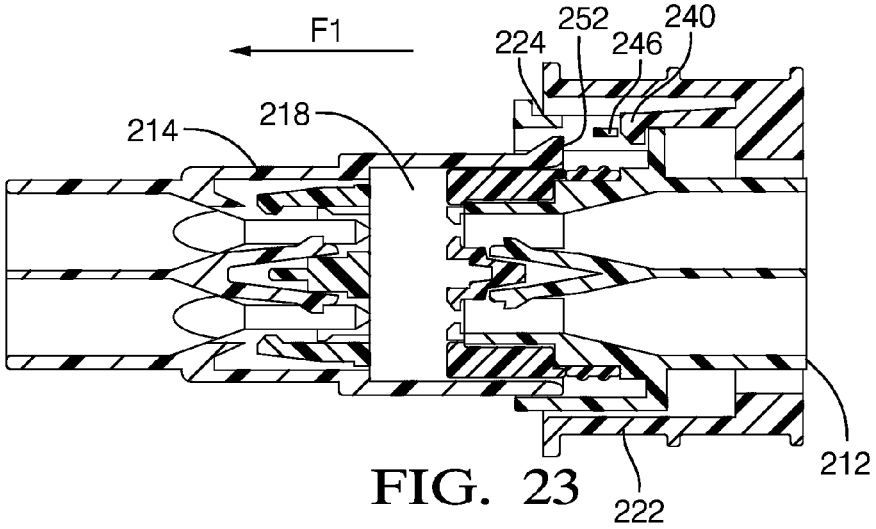
FIG. 23 is a cut away side view of the connector system of FIG. 15 along the section line C-C of FIG. 5 in a partially mated position in accordance with a second embodiment.

FIGS. 21-23 illustrate the connector system 200 as the first force F1 is applied to the sleeve 222 and the first connector 212 engages the second connector 214. As illustrated in FIG. 22, the second protrusion 232 is still rearward of the first protrusion 234 as the first connector 212 is being inserted into the second connector 214. As the first connector body 216 is inserted into the cavity 218 of the second connector body 220, the connector lock arm 226 engages the connector latch 228 and flexes about a flexing member 248 as the lock arm 226 rides up and over the latch 128 until the lock arm 226 clears the latch 228 and snaps into place behind the latch 228 as shown in FIG. 10, thereby securing the first connector 212 to the second connector 214 until it is released by pressing the release button 250 on the forward portion of the lock arm 226.

Figure 26:
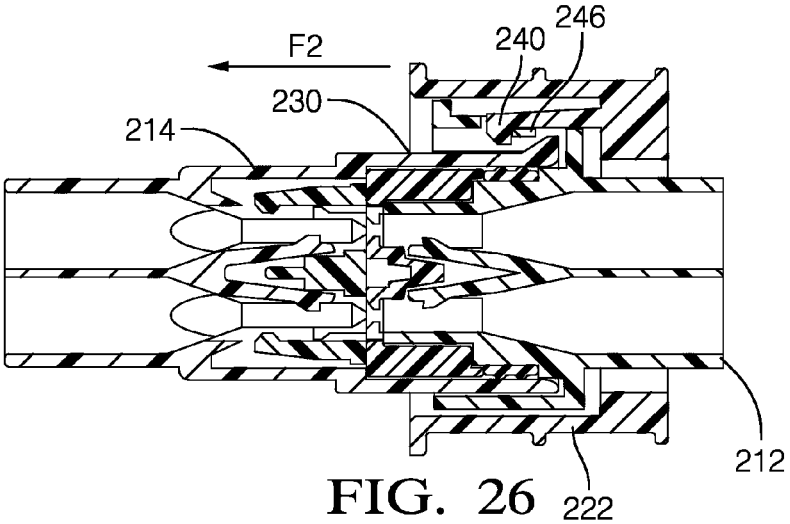
FIG. 26 is a cut away side view of the connector system of FIG. 15 along the section line C-C of FIG. 5 in a fully mated position in accordance with a second embodiment.

As shown in FIGS. 23 and 26, when the first and second connectors 112, 114 are fully mated, a forward edge 252 of the wall defining the second connector cavity 118 engages the sleeve lock 240 flexing the sleeve lock 240 releasing the sleeve lock 240 to slide upward and over the boss 246 and allowing the sleeve 222 to slide from the initial position 224 to the final position 230.

Figure 24:
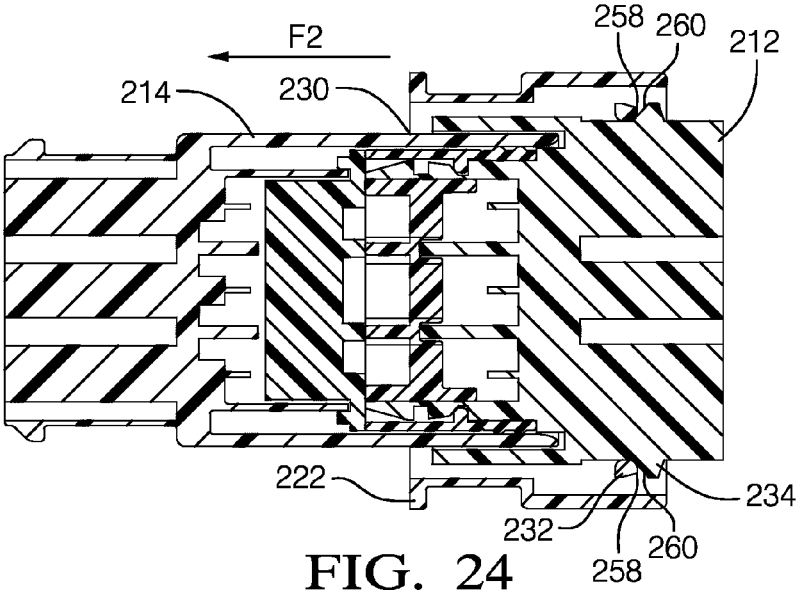
FIG. 24 is a cut away top view of the connector system of FIG. 15 along the section line A-A of FIG. 5 in a fully mated position in accordance with a second embodiment.

FIGS. 24-26 illustrate the connector system 200 as a second force F2 is applied to the sleeve 222 by the operator after the first connector 212 is fully mated with the second connector 214. The second force F2 is applied in the same direction as the first force F1 rather than in a direction opposite the first force F1 as in the connector system 100. As the second force F2 is applied to the sleeve 222, the sleeve 222 slides from the initial position 224 to the final position 230. The angled surface of the leading edge 254 of the second protrusion 232 engages the angled surface of the leading edge 256 of the first protrusion 234. The cantilevered beam 238 flexes and the second protrusion 232 rides up and over the first protrusion 234 until the trailing edge 258 of the second protrusion 232 clears the trailing edge 260 of the first protrusion 234. The trailing edges 258, 260 of the first and second protrusions 232, 234 have a steeper angle than the leading edges 254, 256, therefore the cantilevered beam 238 rapidly snaps back to its initial shape when the second protrusion 232 clears the first protrusion 234 causing a vibration that may be heard by the operator or felt by the operator through the sleeve 222. The second protrusion 232 is forward of the first protrusion 234 when the sleeve 222 is in the final position 230.

The connector system 200 also provides the benefit of a lower connector mating force compared to prior art devices described in the Background of the Invention since the second force F2 required to activate the CPA device 222 is separate from the first force F1 required to mate the first and second connectors 212, 214. The second force F2 required to move the sleeve 222 from the initial position 224 to the final position 230 is greater than the first force F1 required to mate the first and second connector 212, 214 so that the sleeve 222 remains in the initial position 224 when the first force F1 is applied. Although the second force F2 required to activate the CPA device 222 is greater than the first force F1 required to mate the first and second connectors 212, 214, the second force F2 may still be less than two to four times as great as the first force F1 as is required by the prior art devices described in the Background of the Invention.

While the examples presented herein are directed to electrical connectors, other embodiments of the connector system 100, 200 may be envisioned that are adapted for use with hydraulic, pneumatic, optical connectors, or hybrid connectors including connections of various types.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector comprising:

a connector body that defines a first protrusion; and a sleeve axially surrounding the connector body and moveable relative to the connector body along a mating axis, wherein said sleeve defines a second protrusion, wherein the second protrusion is configured to engage the first protrusion when a first force is applied to the sleeve as the connector is mated with a corresponding mating connector, wherein the second protrusion is configured to slide over the first protrusion and then disengage the first protrusion when a second force, distinct from the first force, is applied to the sleeve, thereby moving the sleeve from an initial position to a final position and producing a vibratory response in the sleeve, and wherein the second force is greater than the first force.

2. A method of interconnecting a connector with a corresponding mating connector, the connector having a connector body that defines a first protrusion and a sleeve axially surrounding the connector body and moveable relative to the connector body along a mating axis and defining a second protrusion, the method comprising the steps of:

applying a first force to the sleeve as the connector is mated with the corresponding mating connector, thereby engaging the first protrusion with the second protrusion; and applying a second force, distinct from the first force, to the sleeve after the connector is fully mated with the corresponding mating connector, thereby moving the sleeve from an initial position to a final position, sliding the second protrusion over the first protrusion, and producing a vibratory response in the sleeve, wherein the second force is greater than the first force.

3. The connector according to claim 1, wherein the second force is applied to the sleeve in the same direction as the first force.

4. The connector according to claim 1, wherein the second force is applied to the sleeve in a direction opposite from the first force.

5. The connector according to claim 1, wherein the vibratory response is a tactile vibration.

6. The connector according to claim 1, wherein the vibratory response is an audible vibration.

7. The connector according to claim 1, wherein the sleeve defines a resilient cantilevered beam and a free end of the cantilevered beam defines the second protrusion.

8. A connector comprising:

a connector body that defines a first protrusion; and a sleeve axially surrounding the connector body and moveable relative to the connector body along a mating axis, wherein said sleeve defines a second protrusion, wherein the second protrusion is configured to engage the first protrusion when a first force is applied to the sleeve as the connector is mated with a corresponding mating connector, wherein the second protrusion is configured to slide over the first protrusion and then disengage the first protrusion when a second force, distinct from the first force, is applied to the sleeve, thereby moving the sleeve from an initial position to a final position and producing a vibratory response in the sleeve, and wherein the sleeve defines a sleeve lock configured to hold the sleeve in the initial position until the connector is fully mated with the corresponding mating connector.

9. A connector comprising:

a connector body that defines a first protrusion; and a sleeve axially surrounding the connector body and moveable relative to the connector body along a mating axis, wherein said sleeve defines a second protrusion, wherein the second protrusion is configured to engage the first protrusion when a first force is applied to the sleeve as the connector is mated with a corresponding mating connector, wherein the second protrusion is configured to slide over the first protrusion and then disengage the first protrusion when a second force, distinct from the first force, is applied to the sleeve, thereby moving the sleeve from an initial position to a final position and producing a vibratory response in the sleeve, and wherein the connector defines a connector lock arm configured to engage a connector latch defined by the corresponding mating connector and the sleeve is configured to inhibit disengagement of the connector lock arm from the connector latch when the sleeve is in the final position.

10. The connector according to claim 9, wherein the sleeve defines a lock stop configured to inhibit disengagement of the connector lock arm from the connector latch when a release button defined by the connector lock arm is pressed.

11. The connector according to claim 9, wherein the vibratory response is an audible vibration.

12. The connector according to claim 9, wherein the sleeve defines a resilient cantilevered beam and a free end of the cantilevered beam defines the second protrusion.

13. The method according to claim 2, wherein the second force is applied to the sleeve in the same direction as the first force.

14. The method according to claim 2, wherein the second force is applied to the sleeve in a direction opposite from the first force.

15. The method according to claim 2, wherein the vibratory response is a tactile vibration.

16. The method according to claim 2, wherein the vibratory response is an audible vibration.

17. The connector according to claim 8, wherein the vibratory response is a tactile vibration.

18. The connector according to claim 8, wherein the vibratory response is an audible vibration.

19. The connector according to claim 8, wherein the sleeve defines a resilient cantilevered beam and a free end of the cantilevered beam defines the second protrusion.

20. The connector according to claim 9, wherein the vibratory response is a tactile vibration.

* * * * *